US009546857B2

(12) United States Patent
Rami

(10) Patent No.: US 9,546,857 B2
(45) Date of Patent: Jan. 17, 2017

(54) HYBRID PRIMER

(71) Applicant: Shyam Swaminadhan Rami, Coimbatore (IN)

(72) Inventor: Shyam Swaminadhan Rami, Coimbatore (IN)

( * ) Notice: Subject to any disclaimer, the term of this patent is extended or adjusted under 35 U.S.C. 154(b) by 177 days.

(21) Appl. No.: 14/528,062

(22) Filed: Oct. 30, 2014

(65) Prior Publication Data

US 2016/0216095 A1 Jul. 28, 2016

Related U.S. Application Data

(60) Provisional application No. 62/029,426, filed on Jul. 26, 2014.

(51) Int. Cl.
*F42C 19/08* (2006.01)
*F42C 11/00* (2006.01)

(52) U.S. Cl.
CPC ..... *F42C 19/0834* (2013.01); *F42C 11/008* (2013.01)

(58) Field of Classification Search
CPC ... F42C 19/0834; F42C 11/008; F42C 11/001; F42C 11/04; F42C 19/08; F42C 19/0803; F42C 19/0807; F42C 19/0823; F42C 19/0826; F42C 19/083; F42C 19/0811
USPC ..... 102/202.6, 202, 202.5, 202.8, 202.9; 86/19.8; 89/14.7
See application file for complete search history.

(56) References Cited

U.S. PATENT DOCUMENTS 4,386,567 A * 6/1983 Ciccone ..... F42C 19/14 102/202.5
4,619,202 A * 10/1986 Romer ..... F42B 5/02 102/443
4,917,017 A * 4/1990 Beltz ..... C06C 5/04 102/275.1
H000940 H * 8/1991 Roller ..... F42C 19/0834 102/430
5,129,324 A * 7/1992 Campoli ..... F42B 5/045 102/430
5,155,295 A * 10/1992 Campoli ..... F42B 5/045 102/430
5,179,250 A * 1/1993 Campoli ..... F42B 5/045 102/430

(Continued)

*Primary Examiner* — John D Cooper
(74) *Attorney, Agent, or Firm* — Law Offices of Steven W. Weinrieb

(57) ABSTRACT

A hybrid primer device comprising electric primer and chemical primer housed in a percussion cap. The electrical primer comprises single pin or plurality of electrode pin pair. Each electrode pair comprises of at least one anode and cathode pin which are insulated and arranged at predetermined distance from central axis. The length of each pair of anode and cathode pins varies to help create multiple trigger points across the length of the cartridge. The chemical primer provides ignition of propellant in absence of the electric power. Application of high voltage electric pulse across the electrodes generates electric arcs between the pairs at multiple points inside cartridge resulting in instantaneous combustion of the propellant creating a high pressure in the cartridge case which improves the projectile's performance. The electric arcs generated will continue even after the chemical primer is exhausted thus enabling primer to continuously burn the propellant ensuring complete combustion.

17 Claims, 8 Drawing Sheets

(56) References Cited

U.S. PATENT DOCUMENTS

| | | | | | |
|---|---|---|---|---|---|
| 5,183,961 | A * | 2/1993 | Campoli | F42B 5/067 | 102/439 |
| 5,355,764 | A * | 10/1994 | Marinos | F42C 19/0811 | 102/472 |
| 5,361,702 | A * | 11/1994 | Goetz | F42C 19/12 | 102/202.5 |
| 8,607,702 | B1 * | 12/2013 | Donadio | F42C 19/12 | 102/202 |
| 2003/0005847 | A1 * | 1/2003 | Pierrot | F42B 5/16 | 102/470 |
| 2010/0000438 | A1 * | 1/2010 | Dryer | F41A 1/02 | 102/443 |

* cited by examiner

HYBRID PRIMER

CROSS-REFERENCE TO RELATED APPLICATIONS

The current US application claims priority from U.S. patent application having No. 62/029,426 filed on 26 Jul. 2014.

BACKGROUND OF THE INVENTION

Technical Field of Invention

The present invention generally relates to a weapon technology and particularly relates to an improvement in a primer used in the gun device. The present invention more particularly relates to a hybrid primer for facilitating an instantaneous ignition of a propellant.

Description of Related Art

A conventional primer in use today, is a small container or wafer of impact sensitive explosive material that is used to ignite the main explosive charge of a firearm or an explosive. A primer is an essential part of a cartridge or an artillery shell that initiates the combustion of the propellant which in turn helps provide enough kinetic energy to the projectile by building up necessary pressure.

The traditional primers rely completely on a mechanical strike by a hammer or firing pin on the percussion cap fixed at the rear end of a cartridge or artillery shell to initiate the combustion of the propellant. This method of triggering the propellant has disadvantages of slow and incomplete combustion of the propellant. The mechanical process of triggering the primer is slow as they have only single triggering point and also due to delay introduced by the movement of hammer and the firing pin. In the existing conventional systems the combustion of the main charge or propellant starts only at rear end; this results in slower rate of combustion since the combustion can be triggered only at one end and has to then progress to the other; thus the resulting pressure build up is also slower. This also results in incomplete combustion since a small percentage of the propellant (in the front) is pushed along with the projectile as it leaves the cartridge. The unburned propellant leaving the cartridge causes muzzle flash. Some of the existing electric primers have design issues as they have only on triggering point or are completely reliant on electricity, are not reusable and also most of them are vulnerable to electro-magnetic interferences. Some of the existing electrical primer designs need highly customized firearms and are not compatible with the existing mechanical firearm systems; this is a major drawback. The design flaws in existing electric primer designs make the cartridges difficult to store, handle and use in firearms, which is the reason why they are not widely used.

One of the prior arts discloses a combination of percussion-electric primer operable in a percussion mode or an electric mode. The percussion-electric primer includes the elements of a primer cup, in which an electrically-conducting contact button is disposed at one end thereof, and a booster charge supporting cup is disposed within the other end of the primer cup. A space between the contact button and supporting cup is adapted to receive a supply of priming composition.

Another prior art discloses a weapon for utilizing a combination percussive and electrically responsive cartridge primer includes an electromechanical firing mechanism that operates to fire rounds percussively and electrically, and an electrical controller for regulating the firing of rounds electrically. A method of firing a combination percussive and electrically responsive cartridge primer includes mechanically firing a first round having the primer, and electrically firing subsequent rounds having the primer. Alternately, the energy generating mechanism may include a thermoelectric generator.

However, the ignition method disclosed in the prior arts is conventional in nature and follows a chain reaction. The conventional designs have just one triggering point. The ignition starts only at one end of the cartridge (near percussion cap) and then progresses to the neck (or projectile end) of the cartridge. A significant amount of unburnt propellant is pushed into the barrel along with the bullet. This results in muzzle flash and residue is left after the bullet leaves the gun barrel. The muzzle flash produced by the residual propellants also exposes the soldiers using the firearm. The chain combustion of the propellant in the prior arts results in inefficiency as the propellant power is not fully utilized to translate into greater kinetic energy, hence limiting range of a projectile. Also rate of combustion is much slower in the prior art primer technology leading to low rate of fire.

In the view of foregoing, there is a need for a primer device that allows instantaneous combustion and hence improves the rate of combustion of propellant by using multiple trigger points. There is a need for a primer that can help achieve complete combustion of the propellant within the firearm which can eliminate the muzzle flash. Also there is a need for a primer device to increase a range and accuracy in hitting a target by increasing the kinetic energy of the projectile. Further there is a need for a primer device to reduce or eliminate the residue propellant left in firearm. Further there is a need for a primer device to increase a firing rate with respect to the conventional used firearms.

The above mentioned shortcomings, disadvantages and problems are addressed herein, as detailed below.

OBJECTS OF THE INVENTION

The primary object of the embodiments herein is to provide a hybrid primer that improves the rate of combustion of the propellants by improving the primer design.

Another object of the embodiments herein is to provide multi-point simultaneous triggering of combustion in the cartridge.

Yet another object of the embodiments herein is to provide a primer technology with complete combustion before a bullet or projectile exits the barrel.

Yet another object of the embodiments herein is to provide a primer technology which enables the creation of high pressure with the complete combustion of the propellant in less time which will allow the projectile to leave with greater kinetic energy translating into greater range and accuracy.

These and other objects and advantages of the embodiments herein will become readily apparent from the following detailed description taken in conjunction with the accompanying drawings.

SUMMARY OF THE INVENTION

The various embodiments herein disclose a hybrid primer device comprising an electric primer and a chemical primer housed in a percussion cap. The percussion cap is housed in a base. The electrical primer comprises of a single or plurality of electrode pairs or electrode pins. Each electrode pair comprises of at least one anode and one cathode pin. The anode and the cathode in each pair are insulated from each other. The plurality of anode and cathode are arranged at a predetermined distance from a central axis. The length of each pair of anode and cathode varies to create multiple trigger points across the length of the cartridge.

According to one embodiment herein, each pair of electrodes of variable lengths simultaneously creates an electric arc or a spark on application of high voltage electric pulses across them. The spark leads to ignition of the propellant at multiple points instantaneously to improves the rate of combustion and reduce the triggering time.

According to one embodiment herein, the high voltage electric pulses are applied across the electrode pins to generate continuous electric arc or spark until the propellant is emptied from a cartridge case or a firing chamber to achieve complete combustion.

According to one embodiment herein, the chemical primer housed in a press fitted percussion cap provides ignition of the propellant in absence of the electric primer through a mechanical impact created by a firing pin or a hammer.

According to one embodiment herein, the base of the primer is composed of a non-conducting material. The electrode pins and the percussion cap are fitted in the base made of non-conducting material. The electrode pins are effectively insulated from each other and also from the cartridge case and the firearm.

According to one embodiment herein, the variable length of the electrodes is distributed to provide instantaneous combustion at multiple points. The length of the electrode pin varies covering an area closer to the percussion cap upto the area closer to neck or mouth of the cartridge.

According to one embodiment herein, the plurality of electrode pairs are fixed at a distance from the central axis in a predetermined manner. The predetermined manner comprises adjustment of a gap between the tips of the longer electrode pair less than a length of the shorter electrode pair. The predetermined manner allows an equal current to pass through the longer and the shorter electrode pair on application of high voltage electric pulses.

According to one embodiment herein, a gap between the tips of the longer electrode pins is adjusted by changing an angle of inclination of the longer electrode pins with respect to the base.

The embodiments herein disclose a hybrid primer device comprising an electric primer and a chemical primer housed in a percussion cap. The percussion cap is housed in a base. The electrical primer comprises of electrodes. Each electrode further comprises two or more interconnected pins of variable length. The two or more interconnected pins have a single contact point for applying high voltage power supply. The length of the pins differs to help create multiple trigger points across the length of the cartridge.

According to one embodiment herein, the electric primer consists of a single pin acting as electrode and the cartridge case having the inner walls made of a conducting material acts as a complementing electrode.

According to one embodiment herein, the electric primer consists of a single pin acting as electrode have multiple spikes or thorn like structure.

According to one embodiment herein, the electric primer consists of multiple electrode pins. A distance between the tips of the longer electrode pins are adjusted by changing an angle of inclination with respect the base of the hybrid primer device.

According to one embodiment herein, the electric primer consists of multiple electrode pins. The electrode pins are fixed at a predetermined distance from the centre in a manner that a distance between the tips of the longer electrode pins are adjusted to be less than the length of the shorter electrode pins. A current passing through the longer and shorter electrode pins is nearly equal on application of high voltage electric pulses.

According to one embodiment herein, a distance between the cartridge case and pins is less between the longer electrode pin and the cartridge case as compared to the shorter electrode pins to allow passage of current through the multiple electrode pins to create electric arcs.

An embodiment herein discloses a power supply contact comprising a plurality of complementing power supply terminals, a non-conducting base and a hole at the centre is provided for the passage of the firing pin. The plurality of complementing power supply terminals are fixed on the non-conducting base with the terminals separated by a distance greater than the diameter of an electrode pin contact head to prevent short circuit at the contacts.

According to one embodiment herein, the instantaneous high pressure multiplicatively increases a bullet velocity. The increased bullet velocity increases a target range and accuracy.

According to one embodiment herein, the voltage applied to the pin of the electric primer ranges from few kilovolt to hundreds of thousand kilovolt.

According to one embodiment herein, the base further comprises a plurality of flash hole channels and an anvil.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The other objects, features and advantages will occur to those skilled in the art from the following description of the preferred embodiment and the accompanying drawings in which.

DETAILED DESCRIPTION OF THE INVENTION

In the following detailed description, a reference is made to the accompanying drawings that form a part hereof, and in which the specific embodiments that may be practiced is shown by way of illustration. The embodiments are described in sufficient detail to enable those skilled in the art to practice the embodiments and it is to be understood that the logical, mechanical and other changes may be made without departing from the scope of the embodiments. The following detailed description is therefore not to be taken in a limiting sense.

Figure 1:
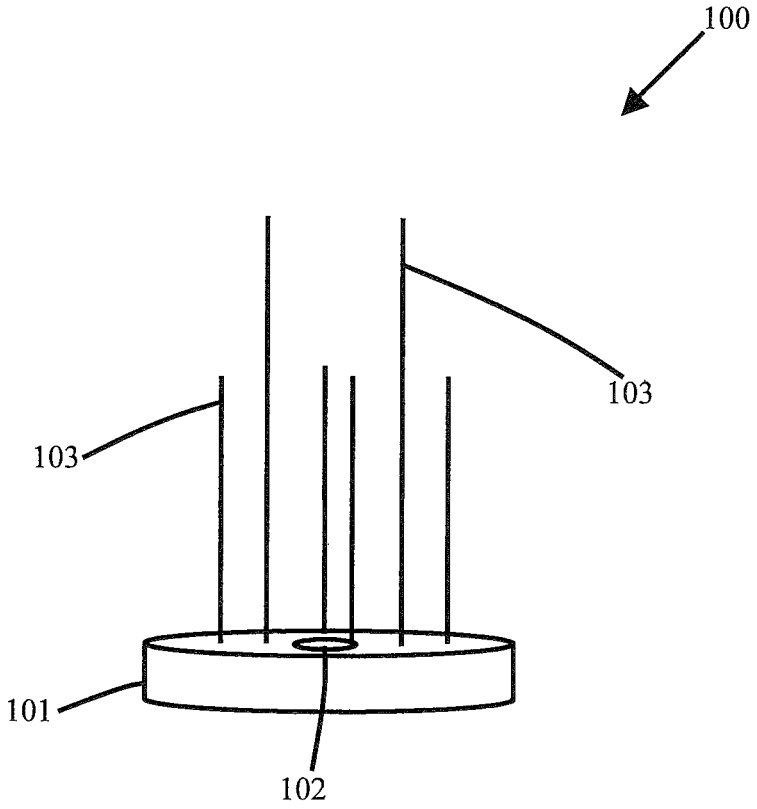
FIG. 1 illustrates a diagram of a side view of the hybrid primer, according to an embodiment herein.

FIG. 1 illustrates a diagram of a side view of the hybrid primer, according to an embodiment herein. With respect to FIG. 1, a hybrid primer device 100 comprising an electric primer and a chemical primer housed in a percussion cap 102. The electrical primer comprises a plurality of electrode pair or conductive pins 103. Each electrode pair 103 comprises one anode and one cathode pin. The anode and the cathode in each pair are insulated from each other. The plurality of anode and cathode 103 are arranged at a predetermined distance from a central axis. The length of each pair of anode and cathode pin increases with increase in its distance from the base. The chemical primer provides ignition of propellant in absence of the electric primer through a mechanical impact. The conductive pins 103 are place in an insulated base 101.

Figure 2:
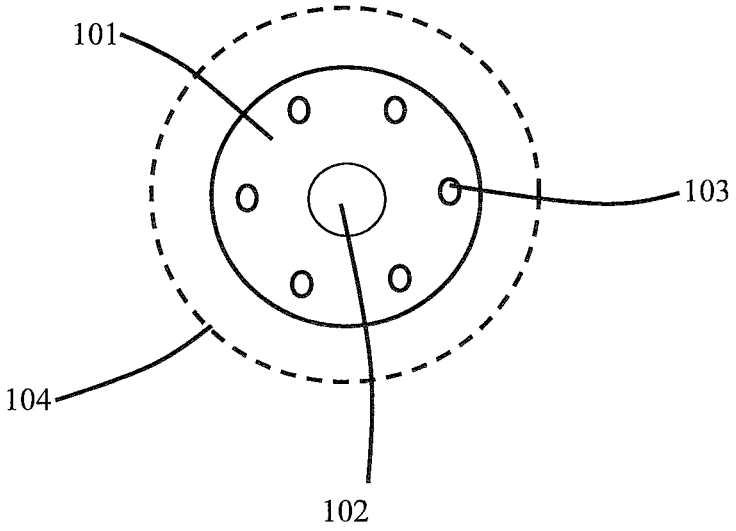
FIG. 2 illustrates a diagram of a bottom view of the hybrid primer, according to an embodiment herein.

FIG. 2 illustrates a diagram of a bottom view of the hybrid primer, according to an embodiment herein. With respect to FIG. 2, the conductive pins 103 are arranged at a predetermined distance from the percussion cap 102 which is at the central axis. The distance of the conductive pins 103 varies on the basis of a required voltage application so that current passes through them. The length of the conductive pins 103 and its distance for the central axis is arranged manipulatively to achieve an instantaneous combustion of the propellant encapsulated in the cartridge case 104 at multiple points. The conductive pins 103 are place in an insulated base 101 to avoid short-circuit. This is achieved by placing the conductive pins 103 on the insulated or non-conducting base 101 with the percussion cap 102 centrally placed in it. The non-conducting base of primer not only insulates the electrodes from each other but also provides insulation to the cartridge case 104 and the ignition chamber during a power supply to the head of the conductive pins 103 of the primer.

Figure 3:
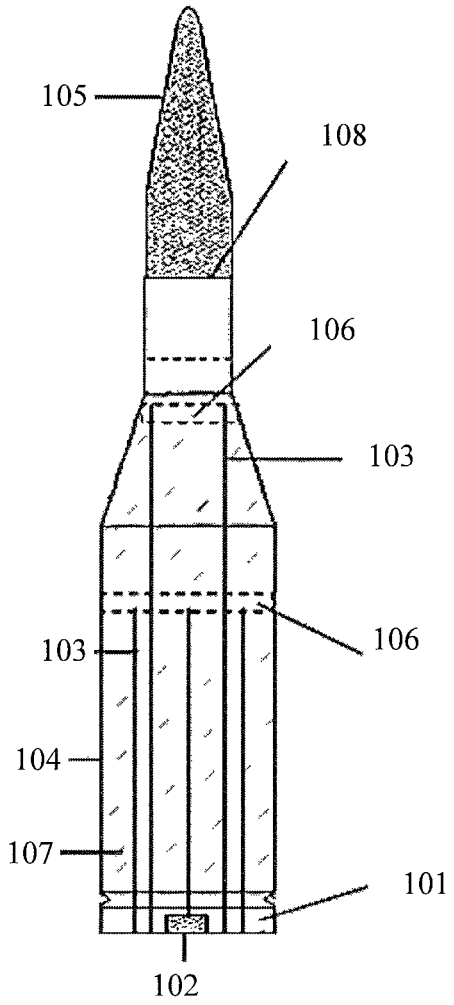
FIG. 3 illustrates a diagram of an application of the hybrid primer device in a centre-fired ammunition cartridge, according to an embodiment herein.

FIG. 3 illustrates a diagram of an application of the hybrid primer device in a centre-fired ammunition cartridge, according to an embodiment herein. With respect to FIG. 3, the hybrid primer is provided in the cartridge case 104 that also holds a projectile 105 of the centre fired ammunition cartridge through a neck 108. An application of a predetermined amount of voltage creates sparks or plasma channel 106 in a zone between the conductive pins 103 near the neck, in the middle and near the base. The sparks in the various zones 106 results in an instantaneous combustion of the propellant 107. The voltage is provided through contact head of the conductive pins 103 that are placed on the base 101 at the predetermined positions from the percussion cap 102.

Figure 4:
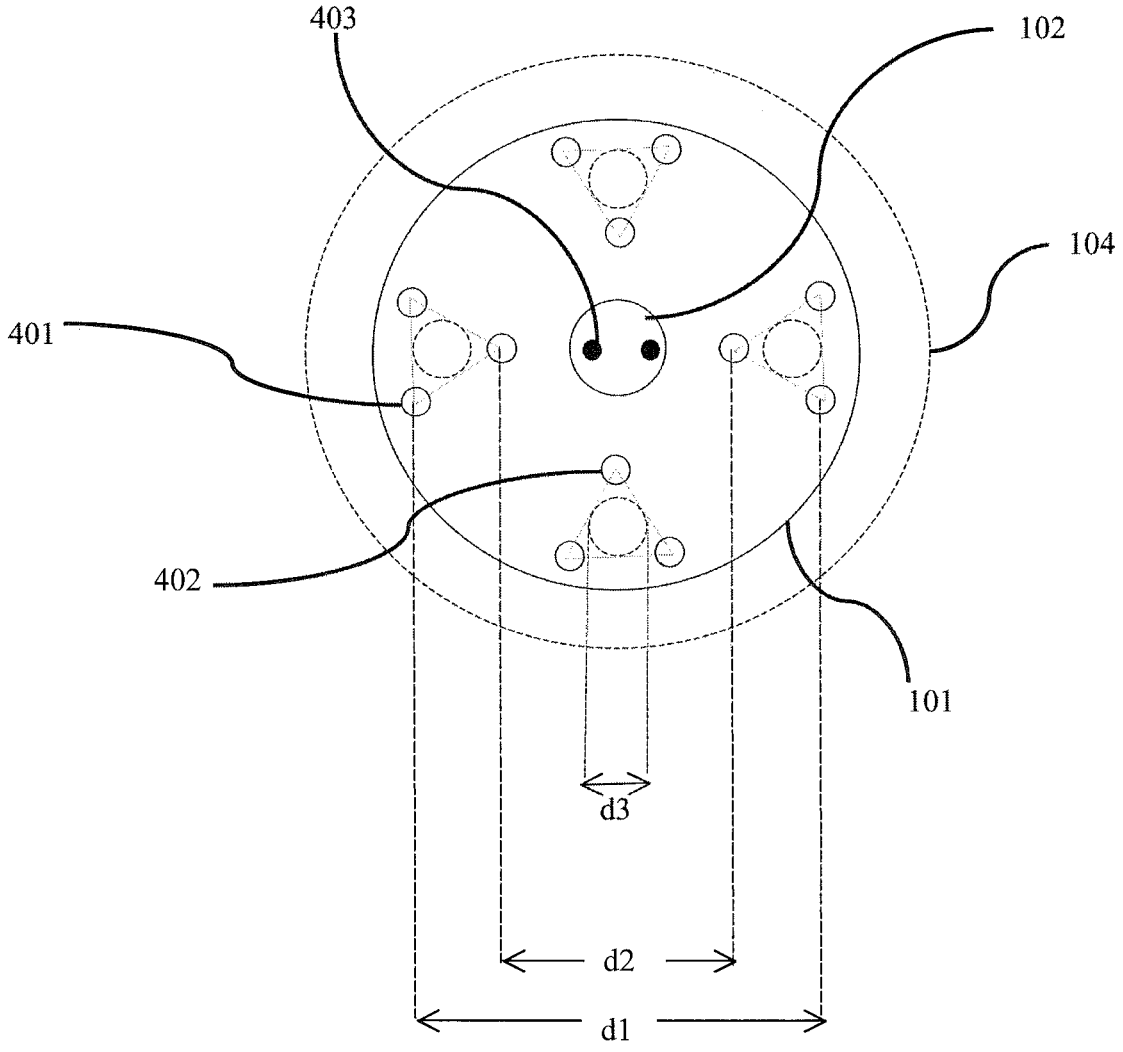
FIG. 4 illustrates a diagram of top view of the hybrid primer, according to one embodiment herein.

FIG. 4 illustrates a diagram of top view of the hybrid primer, according to one embodiment herein. With respect to FIG. 4, the hybrid primer comprises the percussion cap 102 fitted in the centre of the base 101 containing the chemical primer. The percussion cap 102 is surrounded by the electrode pins arranged in a manner such that the longer electrode pin pair 402 is arranged closer that the shorter electrode pin pair 401. This arrangement allows a current to pass simultaneously through both of them creating an electric arc equally at tip ends of both the longer and shorter electrode pins (402 and 401 respectively). The current tries to take the shortest path available between the anode and cathode. The insulation barrier which acts as resistance between the anode and cathode is adjusted by manipulating a distance between the anode and cathode. Thus if the insulation barrier is equal between the longer and shorter electrode pairs (402 and 401 respectively), then the current passes equally between the electrode pairs generating the electric arc or spark instantaneously on application of very high voltage electric power pulse at the contacts. Hence, the distance (d1) between the shorter electrode pair 401 is greater than the distance (d2) between the longer electrode pair 402. The diameter of the electrode pin head that contacts the power supply is represented as d3. The flash holes of the percussion cap are shown as 403.

In an alternate arrangement the flash-holes and anvil may be part of the base of the hybrid primer wherein a percussion-cup containing impact sensitive chemical-primer may be press fitted through the provisioned slot in the base.

In an alternate arrangement if the cartridge case acts as the complementing electrode then the distance between the long pin and the cartridge case (d2) will be less than the distance between the short pin and the cartridge case (d1).

Figure 5A:
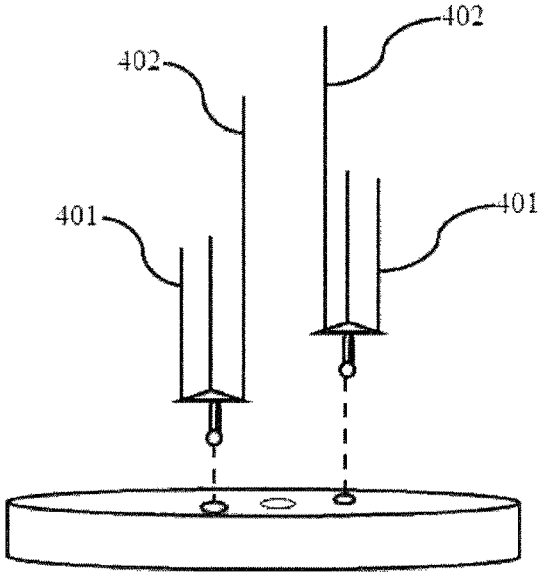
FIG. 5A illustrates a diagram of an alternate arrangement of the electrode pins in the hybrid primer device, according to an embodiment herein.

FIG. 5A illustrates a diagram of an alternate arrangement of the electrode pins in the hybrid primer device, according to an embodiment herein. With respect to FIG. 5, the longer and shorter electrode pins (402 and 401 respectively) are interconnected to act as a single electrode with a single contact to supply power. They are also arranged at appropriate angles to adjust a distance between the electrode pins.

Figure 5B:
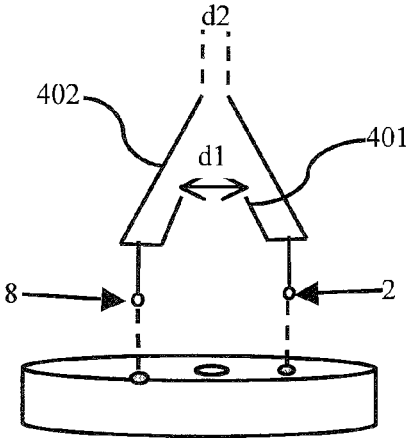
FIGS. 5B and 5C illustrates a side view and a bottom view of an alternate arrangement of the electrode pins in the hybrid primer device, according to an embodiment herein.
Figure 5C:
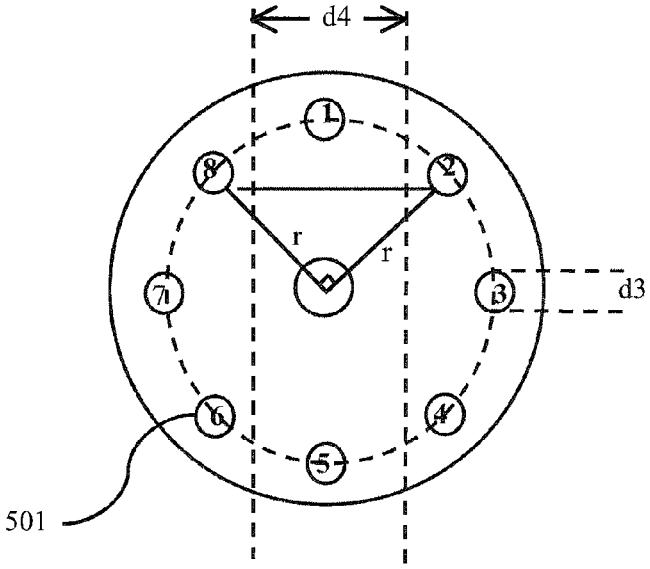

FIGS. 5B and 5C illustrates a side view and a bottom view of an alternate arrangement of the electrode pins in the hybrid primer device, according to an embodiment herein. With respect to FIG. 5B, the arrangement shown in FIG. 5A is modified to reduce the distance between the tips of the longer and shorter electrode pins (402 and 401 respectively). The longer and shorter electrode pins (402 and 401 respectively) are arranged at angle with respect to base in such that each pins from an electrode pair lean towards each other. With respect to FIG. 5C, the electrode pins are arranged at eight equidistant points 501 on the base. The eight electrode pins are arranged at equal distance from each other at an angle of 45° with respect to the centre. The distance d4 is arranged such that the electrode pair (with pins 1 and 5) is not supplied with power while the other three pairs are supplied with power.

According to an exemplary embodiment herein, let us assume that base or pin-heads of the pins 8, 7 and 6 are connected to the positive terminal and the pins 2, 3 and 4 are connected to the negative terminal of the high voltage electric power source. In this case, the electric arc is produced between the electrode pairs 8 and 2 as well as 6 and 4. With higher current rating the electric arc can be produced between electrode 7 and 3 also. This design makes the primer performance more predictable and consistent giving greater accuracy.

According to another embodiment herein, in real case, the electric arcs will be broken intermittently due to movement of the gases and propellant and the electric arc will be produced between any of the complementing electrode pins where the insulation barrier is the least for a given instant. For example intermittent arcs may be produced between pins 7 and 2 or 7 and 4. In order to get consistent performance and accuracy out of the cartridge, it is recommended to have the distance (d4) between the complementing power supply contact terminals such that only one pair of the electrode pins is not in contact with power source while the rest are supplied with power.

Figure 6:
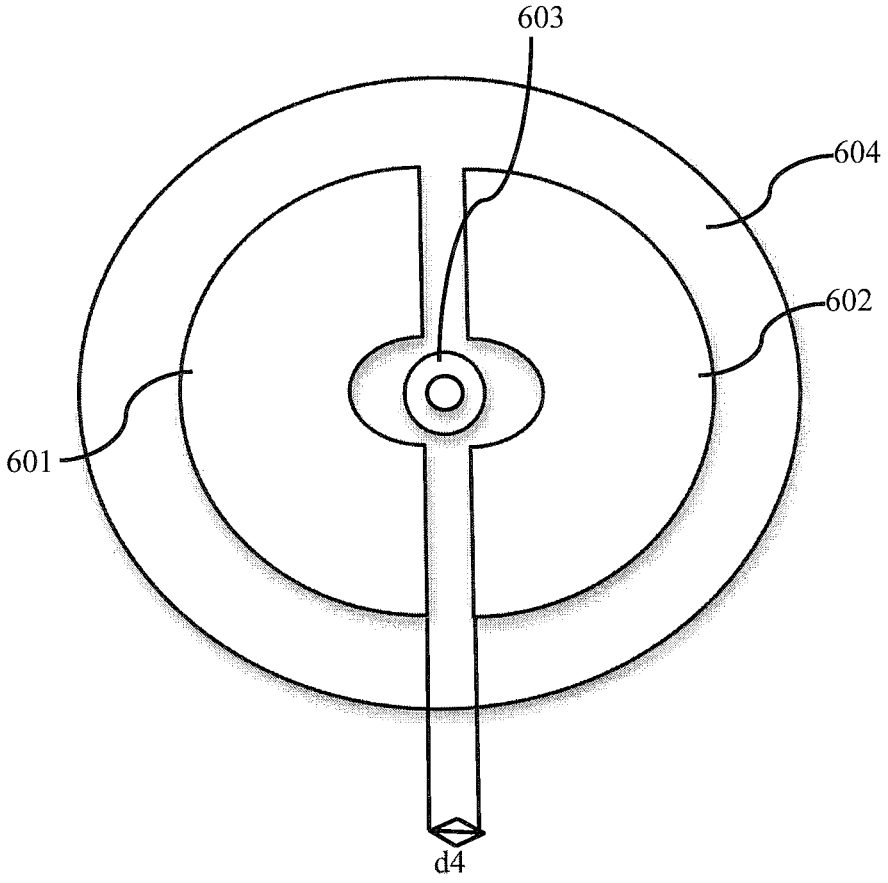
FIG. 6 illustrates an exemplary diagram for a power supply to the hybrid primer device, according to one embodiment herein.

FIG. 6 illustrates an exemplary diagram for a power supply to the hybrid primer device, according to one embodiment herein. With respect to FIG. 6, the anode 601 and the cathode 602 (the electrode pairs) are attached to a non-conducting unit of a bolt 604 with a hole 603 in the middle for a firing pin. The distance (d4) between the anode 601 and cathode 602 is greater than the diameter of the electrode pin head to prevent a short circuit while contacting an electrode pin head at the base. The anode 601 and cathode 602 are designed such that they contact only the electrode pins at the base and not the cartridge case. The distance of the anode 601 or the cathode 602 periphery from the centre is less than the radius of the base to avoid contact with the cartridge case.

Figure 7:
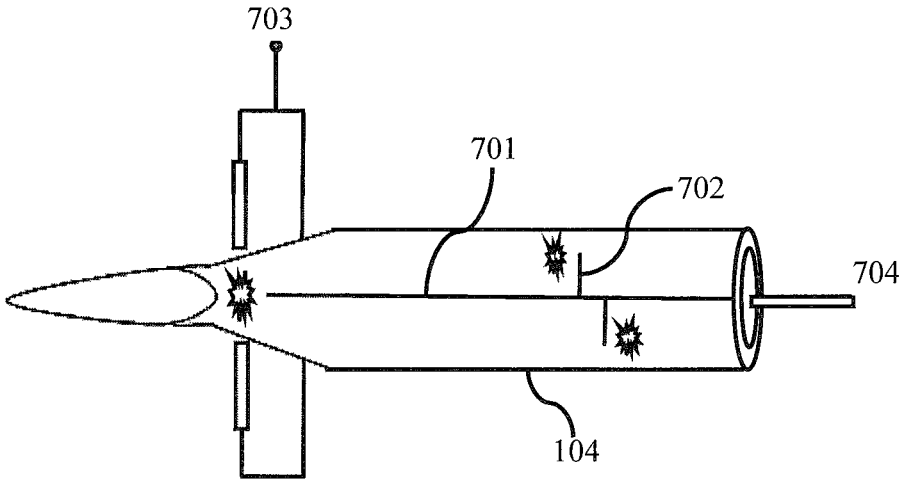
FIG. 7 illustrates a diagram for an alternative arrangement of the hybrid primer, according to an embodiment herein.

FIG. 7 illustrates a diagram for an alternative arrangement of the hybrid primer, according to an embodiment herein. With respect to FIG. 7, the hybrid primer comprises a single pin or electrode 701 with a plurality of optional spikes 702. The cartridge case 104 is made of a conductive material acting as a complementing electrode for the single pin 701. The complementing power supply terminals are shown as 703 and 704.

Figure 8:
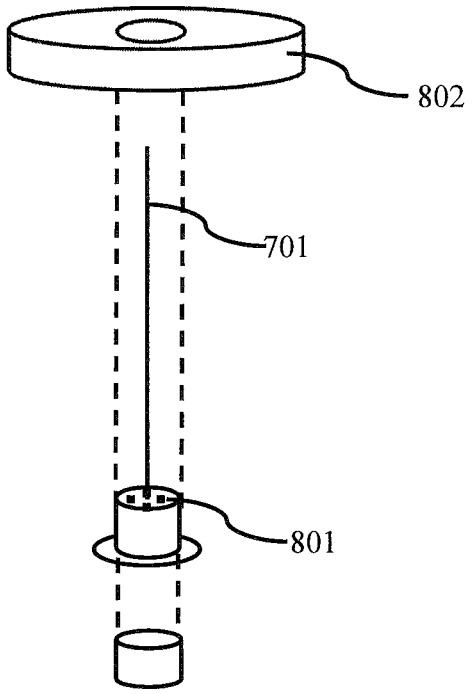
FIG. 8 illustrates an exploded view of the hybrid primer with single pin configuration, according to an embodiment herein.

FIG. 8 illustrates an exploded view of the hybrid primer with single pin configuration, according to an embodiment herein. With respect to FIG. 8, the hybrid primer with single electrode pin 701 has a cylindrical bottom press fitted with the percussion cap. The cylindrical base is provided with flash holes 801. The primer assembly is fitted on the non-conducting base 802.

According to an exemplary embodiment herein, considering a traditional primer based cartridge with about 100 grains is capable of triggering only few grains of gunpowder ignited using the percussion cap resulting in slower rate of combustion as there is only one trigger point and also unlike the present invention discussed here the traditional primer design does not have the capability to continuously produce spark or plasma channel that aids the rapid combustion of propellants. In the case of the hybrid primer design in discussion here, when a high voltage electric power pulse is applied across the electrode pairs, then the spark is produced between them instantaneously. The spark ignites 10 grains of gunpowder between each pair of electrodes. The mechanical strike on the percussion cap simultaneously ignites another 10 grains at one end. Thus, overall 30 grains of 100 is ignited as soon as the conductive pins are triggered at three points near the neck, mid-section and base. After ignition, when a critical pressure is reached the bullet leaves the cartridge and enters the barrel of the firearm. Due to continuous application the high voltage electric power between the primer pins the propellant starts burning even as it exits the cartridge and is completely combusted before it reaches the end of the barrel.

Due to complete combustion of the propellant, a high pressure is created in a miniscule time which is multiple times than the pressure created through conventional primers for the same time. This instantaneous high pressure leads to a higher speed of bullet leaving a barrel and thus ensures better range and accuracy in achieving a target.

According to an embodiment herein, the present hybrid primer has ability to generate same power instantaneously by using least propellant in a cartridge case. For e.g. if a 100 grain of a propellant generates a prefixed amount of power through the conventionally used primer, then same power is generated by burning or ignition of 75 grain or lesser amount of propellant when the present hybrid primer is used.

According to one embodiment herein, if the cartridge is made of a metal, metal alloys or any conducting material then the primer pins can act as anode and the cartridge case can act as cathode (or vice-versa). The spark or plasma channel is created through the application of high-voltage electric power. The primer pins may form a homogenous structure in this case along with the base with sufficient insulation between the base and the casing to prevent short circuit and provide necessary insulation between the electrodes.

According to one embodiment herein, the hybrid primer is also be used in a caseless ammunition. In the caseless ammunition, the chamber or the projectile itself acts as an electrode and the primer forms a part of a bolt. The continuous application of plasma channel results in higher rate of combustion which in turn results in rapid buildup of pressure inside the cartridge case or the chamber and hence helps the projectile to move with greater kinetic energy.

According to one embodiment herein, in one form the hybrid primer is used without the chemical primer and hence acts as a pure electrical primer.

According to another embodiment herein, the electrical primer consists of a single pin, with or without multiple thorns or spikes on it. The pin acts as an electrode and the cartridge case or the encasing chamber acting as the complementing electrode.

In a cartridge with the hybrid primer, there are multiple triggering points inside the cartridge that helps burn more propellant quickly all along the length of cartridge case resulting in much higher rate of combustion. The triggering time is lower hence the firing rate in the firearms using the hybrid primer will be higher. The muzzle flash is considerably reduced or completely eliminated as the continuous application of high voltage electric arcs or sparks completely burn the propellants even as they enter the barrel. Since the propellant completes burning before it exits the barrel it helps improve the stealth signature of soldiers and also significantly reduces the wastage of propellants. The ammunitions made out of the hybrid primer can be universally used in mechanical firearms too. The hybrid primer design does not necessitate change in the dimensions of existing ammunitions.

It is to be understood that the phraseology or terminology employed herein is for the purpose of description and not of limitation. Therefore, while the embodiments herein have been described in teams of preferred embodiments, those skilled in the art will recognize that the embodiments herein can be practiced with modification within the spirit and scope of the claims.

I claim:

1. A hybrid primer device for use within a cartridge having a longitudinal axis and a propellant charged disposed therein, comprising:

an insulated base;

an electrical primer comprising at least one pair of electrode pins, wherein said at least one pair of electrode pins comprises an anode and a cathode, wherein first ends of said anode and said cathode are fixedly mounted within said insulated base and are spaced apart from each other so as to be electrically insulated from each other and yet are adapted to be connected to a power source, wherein second opposite ends of said anode and said cathode are disposed a predetermined distance from each other so as to generate an arc spark between said anode and said cathode when electrical power is supplied to said anode and said cathode, and wherein said anode and said cathode extend substantially axially away from said insulated base for a predetermined axial distance, substantially parallel to the longitudinal axis of the cartridge, such that the spark can be generated at a predetermined distance along the axial extent of the cartridge and at a predetermined distance from said insulated base;

a chemical percussion primer housed within a percussion cap, wherein said percussion cap is disposed within said insulated base and is adapted to generate another spark as a result of a mechanical strike being imparted to said percussion cap; and at least one flash hole defined within said percussion cap so as to permit said spark, generated from said chemical percussion primer housed within said percussion cap as a result of the mechanical strike imparted to said percussion cap, to propagate into the cartridge, within which the propellant charge is disposed, such that the propellant charge, disposed within the cartridge, can be ignited by both of the sparks generated by said at least one anode and said at least one cathode of said electrical primer, and said mechanical strike imparted to said percussion cap.

2. The device as per claim 1, wherein:

said at least one pair of electrode pins comprises a plurality of pairs of electrode pins wherein each pair of electrode pins is of a different axial length such that a plurality of arc sparks are simultaneously created at different axial positions along the axial extent of the cartridge upon application of high voltage electric pulses to said plurality of anodes and said plurality of cathodes, wherein the sparks lead to the instantaneous ignition of the propellant at multiple axial locations within the cartridge so as to improve rate of combustion of the propellant and reduce overall triggering time of the propellant.

3. The device as per claim 2, wherein:

high voltage electric pulses are applied across the plurality of pairs of electrode pins so as to generate plasma or sparks until the propellant is emptied from the cartridge in order to achieve complete combustion.

4. The device as per claim 2, wherein:

said plurality of pairs of electrode pins are disposed within a circumferential array around said longitudinal axis of the cartridge and at a predetermined distance from said longitudinal axis of the cartridge.

5. The device as set forth in claim 4, wherein:

said plurality of pairs of electrode pins disposed within said circumferential array extending around the longitudinal axis of the cartridge comprises two pairs of electrodes equiangularly spaced from each other by means of 180°.

6. The device as set forth in claim 4, wherein:

said plurality of pairs of electrode pins disposed within said circumferential array extending around the longitudinal axis of the cartridge comprises four pairs of electrodes equiangularly spaced from each other by means of 90°.

7. The device as set forth in claim 4, wherein:

said plurality of pairs of electrode pins disposed within said circumferential array extending around the longitudinal axis of the cartridge comprises six pairs of electrodes equiangularly spaced from each other by means of 60°.

8. The device as set forth in claim 4, wherein:

said plurality of pairs of electrode pins disposed within said circumferential array extending around the longitudinal axis of the cartridge comprises eight pairs of electrodes equiangularly spaced from each other by means of 45°.

9. The device as set forth in claim 4, wherein:

each pair of said plurality of pairs of electrode pins comprises an anode and a cathode wherein said anode and cathode electrode pins of each pair of said plurality of pairs of electrode pins have different axial lengths, however each one of said pairs of said anode electrode pins and each one of said pairs of cathode electrode pins are of the same length, and wherein said pairs of said anode and cathode electrode are interconnected together at said first ends thereof so as to have a single contact point to which the high voltage power can be supplied.

10. The device as per claim 9, wherein:

said anode and cathode electrode pins are oriented at a predetermined angle of inclination with respect to said base and a gap defined between said second ends of longer ones of said anode and cathode electrode pins having said different axial lengths is adjustable by changing the angle of inclination of said longer ones of said anode and cathode electrode pins with respect to shorter ones of said anode and cathode electrode pins and said base.

11. The device as per claim 2, wherein:

instantaneous high pressure characteristics, created by said plurality of pairs of electrode pins at a plurality of axial positions along the longitudinal axis of the cartridge, multiplies velocity characteristics of a bullet disposed within the cartridge, wherein increased bullet velocity increases target range and accuracy.

12. The device as per claim 2, wherein:

voltage applied to said plurality of pairs of electrode pins ranges from at least one kilovolt to at least one hundred thousand kilovolts.

13. The device as set forth in claim 2, wherein:

each pair of said plurality of pairs of electrode pins comprising said anodes and said cathodes are of different axial lengths with respect to each other such that one pair of said anode and cathode electrode pins is longer than the other pair of said anode and cathode electrode pins.

14. The device as set forth in claim 13, wherein:

said anode and cathode electrode pins are oriented at a predetermined angle of inclination with respect to said base and a gap defined between said second ends of shorter ones of said anode and cathode electrode pins having said different axial lengths is adjustable by changing the angle of inclination of said shorter ones of said anode and cathode electrode pins with respect to longer ones of said anode and cathode electrode pins and said base.

15. The device as set forth in claim 2, wherein:

said anode and cathode electrode pins of a first pair of said plurality of pairs of electrode pins are oriented at a predetermined angle of inclination with respect to said base which is smaller than a predetermined angle of inclination at which said anode and cathode electrode pins of a second pair of said plurality of pairs of electrode pins are inclined with respect to said base such that a first gap defined between said first pair of said plurality of pairs of electrode pins, which are longer than the length of said second pair of said plurality of pairs of electrode pins, is less than a second gap defined between said second pair of said plurality of pairs of electrode pins.

16. The device as per claim 1, wherein:

said insulated base of said hybrid primer is composed of a non-conducting material, wherein said at least one pair of electrode pins and the percussion cap are fitted within the non-conducting material, and wherein the electrode pins are effectively insulated from each other and also from the cartridge and a firearm.

17. The device as claimed in claim 1, wherein:

the base further comprises a plurality of flash hole channels and an anvil.

* * * * *